US010971057B2

(12) United States Patent
Jung et al.

(10) Patent No.: US 10,971,057 B2
(45) Date of Patent: Apr. 6, 2021

(54) DISPLAY APPARATUS INCLUDING LIGHT EMITTING DIODE MODULE AND LIGHT EMITTING DIODE DRIVER AND CONTROL METHOD THEREOF

(71) Applicant: SAMSUNG ELECTRONICS CO., LTD., Suwon-si (KR)

(72) Inventors: Sungbum Jung, Suwon-si (KR); Sungyong Joo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/562,774

(22) Filed: Sep. 6, 2019

(65) Prior Publication Data

US 2020/0118482 A1 Apr. 16, 2020

(30) Foreign Application Priority Data

Oct. 16, 2018 (KR) ..... 10-2018-0123425

(51) Int. Cl.
*G09G 3/32* (2016.01)
*G09G 3/34* (2006.01)

(52) U.S. Cl.
CPC ..... *G09G 3/32* (2013.01); *G09G 3/342* (2013.01); *G09G 2320/0633* (2013.01)

(58) Field of Classification Search
CPC ... G09G 3/342; G09G 3/32; G09G 2320/0633
See application file for complete search history.

(56) References Cited

U.S. PATENT DOCUMENTS 8,339,053 B2 12/2012 Yamasaki et al.
8,487,550 B2 7/2013 Zhang et al.
9,510,414 B2 11/2016 Kim et al.
(Continued)

FOREIGN PATENT DOCUMENTS

JP 2012-002955 1/2012
JP 2017-078727 4/2017
(Continued)

OTHER PUBLICATIONS

International Search Report and Written Opinion dated Jan. 30, 2020 in counterpart International Application No. PCT/KR2019/013467.

*Primary Examiner* — Kwang-Su Yang
(74) *Attorney, Agent, or Firm* — Nixon & Vanderhye P.C.

(57) ABSTRACT

A display apparatus is provided. The display apparatus according to an embodiment includes an LED module including a plurality of light emitting diodes, an LED driver including a switching element comprising switching circuitry, the LED driver being configured to change a switching frequency of the switching element based on an intensity of a current provided to the LED module, and a processor configured to generate a Pulse Width Modulation (PWM) dimming signal based on pixel information of an input image and provide the signal to the LED driver, wherein the processor is further configured to control the LED driver to increase the switching frequency of the switching element within a dimming duty of the PWM dimming signal by reducing the intensity of the current provide to the LED module based on a pixel value of the input image being less than a threshold value.

20 Claims, 16 Drawing Sheets

(56) References Cited

U.S. PATENT DOCUMENTS

| | | | | |
|---|---|---|---|---|
| 9,548,021 | B2 | 1/2017 | Kim et al. | |
| 9,730,289 | B1 | 8/2017 | Hu et al. | |
| 9,832,829 | B2 | 11/2017 | Ohira | |
| 2009/0066632 | A1* | 3/2009 | Chen | G09G 3/3406 345/102 |
| 2012/0140149 | A1* | 6/2012 | Sakita | G02F 1/133603 349/67 |
| 2012/0217889 | A1* | 8/2012 | Jayabalan | H05B 45/14 315/209 R |
| 2013/0082624 | A1* | 4/2013 | Brassfield | H05B 45/10 315/297 |
| 2013/0321484 | A1 | 12/2013 | Kim et al. | |
| 2014/0042919 | A1* | 2/2014 | Yang | H05B 45/46 315/186 |
| 2015/0124003 | A1* | 5/2015 | Mio | G09G 3/3406 345/690 |
| 2016/0100466 | A1 | 4/2016 | Kim et al. | |
| 2017/0092204 | A1 | 3/2017 | Kim et al. | |

FOREIGN PATENT DOCUMENTS

| | | |
|---|---|---|
| JP | 6210374 | 10/2017 |
| KR | 10-2013-0135487 | 12/2013 |
| KR | 10-2015-0079007 | 7/2015 |
| KR | 10-2016-0039716 | 4/2016 |
| KR | 10-2016-0086491 | 7/2016 |

* cited by examiner $$I_{LED} = \frac{1}{2} \times \frac{V_{CS}}{R_{CS}}$$

| LOW GRAYSCALE OPERATION AREA | | | | | NORMAL OPERATION AREA | |
|---|---|---|---|---|---|---|
| 1step | 2step | 3step | ..... | 30step | ..... | 1024step |
| 00000001 | 0000000010 | 0000000011 | | 0000011110 | | 1111111111 |

DISPLAY APPARATUS INCLUDING LIGHT EMITTING DIODE MODULE AND LIGHT EMITTING DIODE DRIVER AND CONTROL METHOD THEREOF

CROSS-REFERENCE TO RELATED APPLICATION

This application is based on and claims priority under 35 U.S.C. § 119 to Korean Patent Application No. 10-2018-0123425, filed on Oct. 16, 2018, in the Korean Intellectual Property Office, the disclosure of which is incorporated by reference herein in its entirety.

BACKGROUND

1. Field

The disclosure relates to a display apparatus and a controlling method thereof, and for example, to a display apparatus including an LED element and a controlling method thereof.

2. Description of Related Art

A Light Emitting Diode (LED) is a semiconductor light emitting element that converts a current into light. Recently, light emitting diode (LEDs) have been increasingly used as a light source for displays, a light source for automobiles, and a light source for illumination because the luminance of the LED has increased. It is also possible to implement a light emitting diode that emits white light with excellent efficiency using a fluorescent material or combining light emitting diodes of various colors.

An LED driver used for driving the light emitting diode provides a current to a light emitting diode by a switching operation of a switching element. However, a problem lies in that the change in brightness is not linearly expressed by the switching operation of the switching element in a low grayscale range.

SUMMARY

Embodiments of the disclosure relate to providing a display apparatus capable of changing a luminance linearly by changing a switching frequency of a switching element in a low grayscale range and a controlling method thereof.

According to an example embodiment, a display apparatus is provided, the display apparatus including an LED module including a plurality of light emitting diodes, an LED driver including a switching element comprising switching circuitry, the LED driver being configured to change a switching frequency of the switching element based on an intensity of a current provided to the LED module, and a processor configured to generate a Pulse Width Modulation (PWM) dimming signal based on pixel information of an input image and to provide the signal to the LED driver, wherein the processor is further configured to control the LED driver to increase the switching frequency of the switching element within a dimming duty of the PWM dimming signal by reducing the intensity of the current provide to the LED module based on a pixel value of the input image being less than a threshold value.

The processor may be provided in a main board, and the LED driver may be provided in a power board, wherein the main board is configured to provide the PWM dimming signal generated by the processor to the power board.

The LED driver may be configured to increase the switching frequency of the switching element based on the intensity of the current provided to the LED module being reduced, and to reduce the switching frequency of the switching element based on the intensity of the current provided to the LED module being increased.

The processor may be further configured to obtain the dimming duty of the PWM dimming signal based on the pixel information of the input image, to compensate the obtained dimming duty based on the reduced intensity of the current based on the pixel value of the input image being less than the threshold value, and to provide the PWM dimming signal for which the dimming duty is compensated to the LED driver.

The processor may provide a signal indicating pixel information related to the PWM dimming signal to the LED driver, wherein the LED driver is configured to increase the switching frequency of the switching element based on the PWM dimming signal corresponding to an image signal being less than the threshold value based on the pixel information.

The LED driver may include a first resistance comprising at least one first resistor including one end connected to one end of the switching element, a second resistance comprising at least one second resistor including one end connected to the first resistance, and a first switch disposed between another end of the first resistance and another end of the second resistance, wherein the processor is further configured to control the LED driver to turn off the first switch to prevent the first resistance from being connected to the second resistance based on the pixel value of the input image being equal to or more than the threshold value, and to turn on the first switch to connect the first resistance to the second resistance in parallel based on the pixel value of the input image being less than the threshold value.

The LED driver may be further configured to increase the switching frequency of the switching element based on a current sensed by the first resistance being reduced as the first resistance and the second resistance are not connected, and reduce the switching frequency of the switching element based on a current sensed by the first resistance and the second resistance being increased as the first resistance and the second resistance are connected in parallel.

The LED driver may include a first diode including a cathode connected to one end of the LED module and an anode connected to the other end of the switching element, an inductor including one end connected to an anode of the first diode and the other end of the switching element, and another end of the inductor connected to another end of the LED module, and a first capacitor including one end connected to both a cathode of the first diode and one end of the LED module, and the another end of the first capacitor connected to both the other end of the LED module and the other end of the inductor, wherein one end of the first resistance is connected to a ground terminal of an input power source, and the other end is connected to one end of the switching element.

The LED driver may include a second diode including an anode connected to the input power source and a cathode connected to one end of the LED module, and a second capacitor including one end connected to the cathode of the second diode, and another end of the second capacitor connected to a ground terminal of the input power source.

The LED driver may include a third capacitor including one end connected to the first capacitor, and a second switch disposed between the other end of the first capacitor and another end of the third capacitor, wherein the processor is further configured to control the LED driver to turn off the second switch based on the pixel value of the input image being less than the threshold value, and turn on the second switch based on the pixel value of the input image being equal to or greater than the threshold value.

The LED driver may operate according to a peak current mode control method.

The LED driver may include a first driver including the switching element, the first driver being configured to control the current provided to the LED module through a switching operation of the switching element, and a second driver configured to provide a control signal for controlling the switching operation of the switching element to the LED driver.

According to an example embodiment, a method for controlling a display apparatus including a switching element and an LED driver that changes a switching frequency of the switching element based on an intensity of a current provided to an LED module, the method including generating a Pulse Width Modulation (PWM) dimming signal based on pixel information of an input image and providing the signal to the LED driver, and increasing the switching frequency of the switching element within a dimming duty of the PWM dimming signal by reducing the intensity of the current provided to the LED module based on a pixel value of the input image being less than a threshold value.

The LED driver may increase the switching frequency of the switching element based on the intensity of the current provided to the LED module being reduced, and reduce the switching frequency of the switching element based on the intensity of the current provided to the LED module being increased.

The method may further include obtaining the dimming duty of the PWM dimming signal based on the pixel information of the input image, and compensating the obtained dimming duty based on the reduced intensity of the current based on the pixel value of the input image being less than the threshold value, and providing the PWM dimming signal for which the dimming duty is compensated to the LED driver.

The method may further include the LED driver receiving a signal indicating pixel information related to the PWM dimming signal, wherein the increasing of the switching frequency of the switching element comprises increasing the switching frequency of the switching element based on identification that the PWM dimming signal corresponds to an image signal less than the threshold value based on the pixel information.

The LED driver may include a first resistance comprising at least one first resistor including one end connected to one end of the switching element, a second resistance comprising at least one second resistor including one end connected to the first resistance, and a first switch disposed between another end of the first resistance and another end of the second resistance, wherein the increasing of the switching frequency of the switching element comprises controlling the LED driver to turn off the first switch to prevent the first resistance from being connected to the second resistance based on the pixel value of the input image being less than the threshold value, and turn on the first switch to connect the first resistance to the second resistance in parallel based on the pixel value of the input image being less than the threshold value.

The LED driver may be configured to increase the switching frequency of the switching element based on a current sensed by the first resistance being reduced as the first resistance and the second resistance are not connected, and to reduce the switching frequency of the switching element based on a current sensed by the first resistance and the second resistance being increased as the first resistance and the second resistance are connected in parallel.

The LED driver may include a first diode including a cathode connected to one end of the LED module and an anode connected to the other end of the switching element, an inductor including one end connected to both an anode of the first diode and the other end of the switching element and another end connected of the inductor connected to the other end of the LED module, and a first capacitor including one end connected both to a cathode of the first diode and one end of the LED module and another end of the first capacitor connected to the other end of the LED module and the other end of the inductor, wherein one end of the first resistance is connected to a ground terminal of an input power source, and the other end is connected to one end of the switching element.

The LED driver may include a second diode including an anode connected to the input power source and a cathode connected to one end of the LED module, and a second capacitor including one end connected to a cathode of the second diode, and another end of the second capacitor connected to a ground terminal of the input power source.

The LED driver may include a third capacitor including one end connected to the first capacitor, and a second switch disposed between the other end of the first capacitor and another end of the third capacitor, wherein the method further comprises controlling the LED driver to turn off the second switch based on the pixel value of the input image being less than the threshold value, and to turn on the second switch based on the pixel value of the input image being equal to or more than the threshold value.

The LED driver may operate according to a peak current mode control method.

According to the above-described various example embodiments, the linearity of luminance change may be improved by increasing a switching frequency of a switching element in a low grayscale range. In addition, in other areas, the switching frequency may be maintained to prevent and/or reduce an increase in component temperature, an increase in price, and the like.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
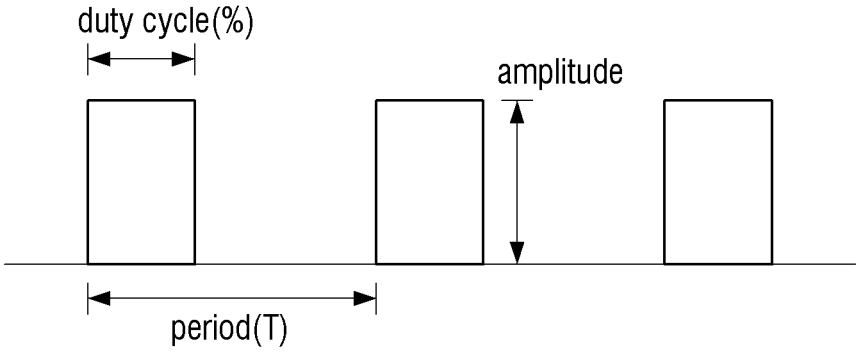
FIG. 1 is a diagram illustrating an example PWV dimming method for understanding the disclosure.

Hereinafter, various example embodiments of the disclosure will be described in greater detail with reference to the accompanying drawings.

The terms used in this disclosure will be briefly described, and the disclosure will be described in detail.

All the terms used in this disclosure including technical and scientific terms have the same meanings as would be generally understood by those skilled in the related art. However, these terms may vary depending on the intentions of the person skilled in the art, legal or technical interpretation, and the emergence of new technologies. In addition, some terms may be arbitrarily selected. These terms may be understood as having the meaning defined herein and, unless otherwise specified, may be understood based on the entire contents of this disclosure and common technical knowledge in the art.

The disclosure is not limited to any particular embodiment disclosed below and may be implemented in various forms and the scope of the disclosure is not limited to the following example embodiments. In addition, all changes or modifications derived from the meaning and scope of the claims and their equivalents should be understood as being included within the scope of the disclosure. In the following disclosure, the configuration which is publicly known but irrelevant to the gist of the disclosure may be omitted.

The terms such as "first," "second," and so on may be used to describe a variety of elements, but the elements should not be limited by these terms. The terms are used simply to distinguish one element from other elements.

The singular expression also includes the plural meaning as long as it does not conflict with the context. In this disclosure, terms such as 'include' and 'have/has' should be understood as designating as including such features, numbers, operations, elements, components or a combination thereof in the disclosure, and not to exclude the existence or possibility of adding one or more of other features, numbers, operations, elements, components or a combination thereof.

In the disclosure, the expressions "A or B," "at least one of A and/or B," or "one or more of A and/or B," and the like include all possible combinations of the listed items.

In an example embodiment, 'a module', 'a unit', or 'a part' perform at least one function or operation, and may be realized as hardware, such as a processor or integrated circuit, software that is executed by a processor, or a combination thereof. In addition, a plurality of 'modules', a plurality of 'units', or a plurality of 'parts' may be integrated into at least one module or chip and may be realized as at least one processor except for 'modules', 'units' or 'parts' that should be realized in a specific hardware.

Hereinafter, various example embodiments of the disclosure will be described in greater detail with reference to the accompanying drawings. However, the disclosure may be embodied in many different forms and is not limited to the embodiments described herein. In order to clearly illustrate the disclosure in the drawings, some of the elements that are not essential to the complete understanding of the disclosure may be omitted for clarity, and like reference numerals refer to like elements throughout the disclosure.

Example embodiments of the disclosure will be described in greater detail with reference to the accompanying drawings.

FIG. 1 diagram illustrating an example PWV dimming method according to an embodiment of the disclosure.

A display apparatus may, for example, and without limitation, be embodied as Liquid Crystal Display (LCD) using LED as a backlight light source, a LED display using LED as a display light source, or the like.

The display apparatus may generate a dimming signal for driving LED based on pixel information of an input image. The dimming signal may include at least one of an analog dimming signal and a Pulse Width Modulation (PWM) dimming signal. Analog dimming may express a different grayscale by adjusting an intensity of a current flowing through LED, and PWM dimming may express a different grayscale by adjusting a time at which LED is turned on within a predetermined period. It should be understood that the grayscale of the image may be expressed based on the PWM dimming, but analog dimming may also be used.

Referring to FIG. 1, the PWM dimming signal may be expressed by period, amplitude, and duty ratio (e.g., duty cycle), and the brightness of LED may be adjusted by controlling the duty ratio within the first period, e.g., a time during which LED is turned on. However, when the analog dimming is added to the PWM dimming, the amplitude, e.g., the intensity of the current may also be adjusted on a cycle basis.

The LED driver may be configured to provide a constant current to the LED based on the PWM dimming signal. The LED driver may include a switching element, and provide a constant current to the LED through the switching operation of the switching element. For example, the LED driver may include a DC/DC converter. The DC/DC converter may convert a DC voltage converted by an AC/DC convert into a voltage appropriate to the LED. For example, the DC/DC converter may, for example, be implemented as a buck converter that is one type of a step-down converter, but is not limited thereto. For example, it is also possible to implement the DC/DC converter as a step-up converter (a boost converter), a step-up/down converter (a buck-boost converter), or the like.

The switching element included in the LED driver may perform switching according to the switching frequency within the PWM dimming duty. However, the PWM duty may be short within a low grayscale range, the number of times of switching may be small in the PWM diming duty, and accordingly, the brightness difference according to the grayscale level may be large, so that the brightness change cannot be expressed linearly.

Accordingly, various example embodiments that can express a luminance change linearly in a low grayscale image through adjustment of the switching frequency will be described.

Figure 2:
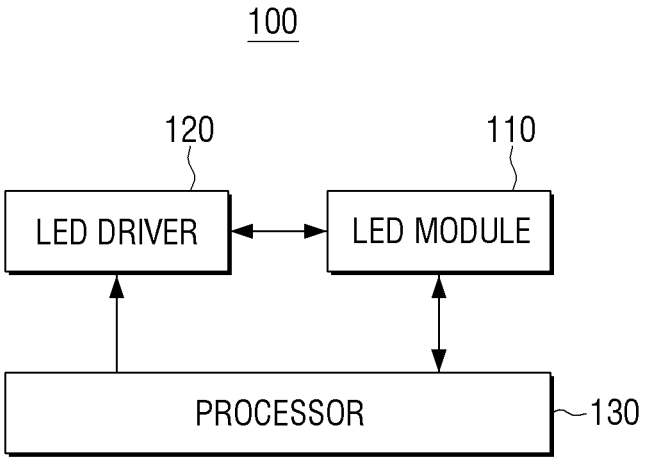
FIG. 2 is a block diagram illustrating an example configuration of a display apparatus according to an embodiment of the disclosure.

FIG. 2 is a block diagram illustrating an example configuration of a display apparatus according to an embodiment of the disclosure.

Referring to FIG. 2, a display apparatus 100 may include an LED module (e.g. including light emitting diodes) 110, an LED driver (e.g., including LED driving circuitry) 120 and a processor (e.g., including processing circuitry) 130.

The LED module 110 may include a plurality of light emitting diodes.

According to an embodiment, the LED module 110 may include at least one LED array in which a plurality of LEDs are connected in series, in parallel, or in series/in parallel.

The LED module 110 may perform different functions according to example embodiments of the display apparatus 100. For example, when the display apparatus 100 is embodied as an LCD device, the LED module 110 may perform a backlight function, and when the display apparatus 100 is embodied as an LED display apparatus, the display apparatus 100 may perform a function as a display element. However, it will be understood that the disclosure is not limited thereto.

According to an embodiment, the display apparatus 100 may include a plurality of LED modules. For example, the plurality of LED modules may be connected to form a backlight or a display panel. However, for ease of explanation, it is assumed that a single LED module 110 is provided, and it will be understood that the disclosure is not limited thereto.

The LED driver 120 may provide a constant current to the LED module 110 by the switching operation of the switching element. The switching element may, for example, be embodied as a MOSFET transistor. For example, the LED driver 120 may include a step-down DC-DC converter, but is not limited thereto. The LED driver 120 may be embodied as a step-up type or step down/up type. In addition, the LED driver 120 may be provided for each LED module 110, but may also be provided for the plurality of LED modules 110 depending on example embodiments. It is also possible that the plurality of LED drivers 120 are provided for a single LED module 110.

The LED driver 120 may compare a current flowing through the LED module 110 with a reference current, and control switching of a switching element so that a constant current corresponding to a dimming signal may flow through the LED module 110. The LED driver 120 may operate to increase the switching frequency of the switching element when the intensity of the current is reduced, and reduce the switching frequency of the switching element when the intensity of the current provided to the LED module 110 is increased.

The LED driver 120 may include a first resistance (e.g., including at least one resistor) connected to one end of the switching element, a second resistance (e.g., including at least one second resistor) connected to the first resistance in parallel, and a first switch disposed between the first resistance and the second resistance. In other words, when the first switch is turned on, the first and second resistances are connected in parallel, and the first switch is turned off, only the first resistance may be connected to the switching element. Connection of the first resistance and parallel connection of the first and second resistances connected to the switching element may function as a sensing resistance for sensing a current (or a voltage) provided to the LED module 110. A detailed description thereof will be made below.

The processor 130 may include various processing circuitry, such as, for example, and without limitation, one or more central processing unit (CPU), a microcontroller unit (MCU), a micro processing unit (MPU), a controller, an application processor (AP), a communication processor (CP), an ARM processor, and the like. The processor 120 may be implemented as a system on chip (SoC), a large scale integration (LSI) with a built-in processing algorithm, or in the form of a field programmable gate array (FPGA).

The processor 130 may generate a PWM dimming signal based on pixel information of an input image. The pixel information may be grayscale information (or luminance information). The PWN dimming signal may be a signal for controlling a ratio of turning on and turning off of LED based on dimming duty, e.g., a duty ratio (%). For example, a current applying time (dimming duty) with respect to a high grayscale pixel may be adjusted to be relatively long during a predetermined dimming period, and a current applying time (dimming duty) with respect to a low grayscale pixel may be adjusted to be relatively short. The input image may be received through an input/output interface (not shown) or a communication interface (not shown). The input/output interface may, for example, and without limitation, be an interface of any one of a high-definition multimedia interface (HDMI), a mobile high-definition link (MHL), a universal serial bus (USB), a display port (DP), a thunderbolt, a Video Graphics Array (VGA) port, an RGB port, a D-subminiature (D-SUB), and a digital visual interface (DVI), or the like. The input/output interface may operate according to various communication standards such as WiFi, Bluetooth, ZigBee, 3rd Generation (3G), 3rd Generation Partnership Project (3GPP), Long Term Evolution (LTE), $4^{th}$ Generation (4G), $5^{th}$ Generation (5G), or the like.

The processor 130 may control the LED driver 120 to change the switching frequency of the switching element included in the LED driver 120 based on pixel information of an input image. In other words, the switching element may be turned on or off according to the switching frequency within the dimming duty of the PWM dimming signal. According to an embodiment, the number of times of turning on/off of the switching frequency within the dimming duty of the PWM dimming signal may be adjusted based on pixel information.

The processor 130 may control the display apparatus to increase the switching frequency of the switching element by reducing the magnitude of the current provided to the LED module 110 in the case of a low grayscale in which the pixel value of the input image is less than a threshold value. In other words, the number of times of turning on/off of the switching frequency may increase with respect to the low grayscale image. In this case, it is considered that the analog dimming is performed because the magnitude of the current provided to the LED module 110 is reduced. The threshold value may be determined based on a grayscale value (or a luminance value) which is commonly considered as a low grayscale (or a low luminance). For example, the threshold grayscale may be determined as 31 grayscales with 10 bit grayscale expression (0 to 1023 grayscales), but it should be understood that the threshold value may vary depending on the implementation performance of the display apparatus 100, a designing method of a manufacturer, etc.

According to an embodiment, the LED driver 120 may include a first resistance including one end connected to one end of a switching element, a second resistance including one end connected to the first resistance, and a first switch disposed between the other end of the first resistance and the other side of the second resistance. In this case, the processor 130 may control the LED driver 120 to turn on the first switch, when a pixel value of an input image is equal to or more than a threshold value, and turn off the first switch and to reduce the intensity of the current provided to to the LED module 110 when a pixel value of an input image is less than a threshold value.

When the first switch is turned off and a resistance is increased, for example, when only the first resistance is connected, the intensity of the sensed current may be reduced, and thus the switching frequency may increase according to the operation characteristic of the LED driver 120. When the first switch is turned on, the first and second resistances may be connected in parallel to reduce the resistance, and the intensity of the sensed current may increase accordingly. Therefore, the switching frequency may decrease according to the operation characteristic of the LED driver 120. When the first switch is turned off, only the first resistance may be connected to the switching element. As a result, a resistance may increase compared to the case in which the first and second resistances are connected in parallel. Therefore, the switching frequency may increase according to the operation characteristic of the LED driver 120 because the intensity of the sensed current is reduced. According to an embodiment, the turning on of the first switch may be considered as a normal operation mode, and thus the first and second resistances may be determined as an appropriate resistance value based thereon.

The processor 130 may obtain a dimming duty based on pixel information of an input image, compensate the dimming duty obtained based on the intensity of the current reduced when a pixel value of an input image is less than a threshold value, for example, the intensity of the current reduced as the first resistance and the second resistance are connected in parallel, and provide the PWM dimming signal for which the dimming duty is compensated to the LED driver 120. According to an embodiment, the intensity of the current provided to the LED module 110 may be reduced or the switching frequency may increase with respect to a low grayscale image less than a threshold value, and the luminance may be lowered accordingly. Therefore, this is for compensating the dimming duty.

The processor 130 may provide pixel information related to a PWM dimming signal to the LED driver 120. The LED driver 120 may increase the switching frequency of the switching element when the PWM dimming signal is identified as corresponding to an image signal less than a threshold value based on pixel information. The LED driver 120 may operate according to the duty of the PWM signal, but cannot identify whether the PWM dimming signal is a PWM dimming signal according to a low grayscale image. Therefore, the processor 130 may provide a signal indicating grayscale information to the LED driver 120 apart from the PWM dimming signal.

The LED driver 120 may further include a first diode including a cathode connected to one end of the LED module 110, and an anode connected to the other end of the switching element, an inductor including one end connected to both an anode of the first diode and the other end of the switching element, and the other end connected to the other end of the LED module 110, and a first capacitor including one end connected to both the cathode of the first diode and one end of the LED module 110, and the other end connected to both the other end of the LED module 110 and the other end of the inductor. In this case, one end of the first resistance may be connected to a ground terminal of an input power source, and the other end may be connected to one end of the switching element.

The LED driver 120 may include a second diode including an anode connected to an input power source and a cathode connected to one end of the LED module 110, and a second capacitor including one end connected to the cathode of the second diode and the other end connected to the ground terminal of the input power source.

The LED driver 120 may include a third capacitor including one end connected to the first capacitor and the second switch disposed between the other end of the first capacitor and the other end of the third capacitor. In this case, the processor 130 may control the LED driver 120 to turn off the second switch when a pixel value of an input image is less than a threshold value, and turn on the second switch when a pixel value of an input image is equal to or more than a threshold value.

Figure 3:
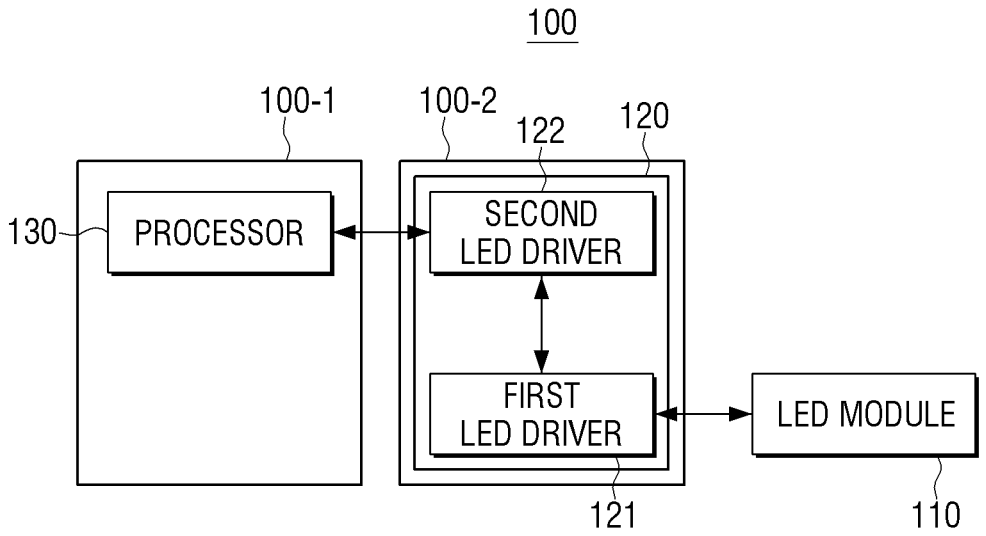
FIG. 3 is a block diagram illustrating an example embodiment of a display apparatus according to an embodiment of the disclosure.

FIG. 3 is a diagram illustrating an example display apparatus according to an embodiment of the disclosure.

Referring to FIG. 3, the display device 100 may include a main board 100-1 and a power board (or a sub-board) 100-2. The main board 100-1 may provide a PWM dimming signal generated by the processor 130 to the power board 100-2.

The main board 100-1 may include the processor 130, and the power board 100-2 may include an LED driver 120 and an LED module 110. However, according to an embodiment, the LED module 110 may be provided outside the power board 100-2.

According to an embodiment, the power board 100-2 may include a power supply (e.g., Switching Mode Power Supply (SMPS)), and the LED driver 120 may be disposed at the rear end of the power supply so that a voltage may be applied to the LED driver 120 from the power supply. According to another embodiment, a voltage may be applied to the LED driver 120 from a separate power source device. Also, it is also possible that the SMPS and the LED driver 120 may be integrally formed in a module format.

According to another embodiment, the processor 130 may be embodied as a DSP, and embodied as one chip with the LED driver 120 implemented as a digital driver IC.

In some cases, the main board 100-1 and the power board 100-2 may be embodied in separate devices. For example, when an image processing apparatus and a display apparatus are separately embodied, the operation may be performed by a separate image processing device (not shown). For example, the image processing apparatus may be embodied as various apparatuses capable of image processing such as a step-box box, a sending box, etc.

According to an embodiment, the LED driver 120 may include a first LED driver 121 and a second LED driver 122.

The first LED driver 121 may include a switching element, and control a current provided to the LED module 110. According to an embodiment, the first LED driver 121 may be embodied as an LED driving circuit of buck converter type.

The second LED driver 122 may provide a control signal for controlling the on/off operation of the first switch, and a control signal for controlling the switching operation of the switching element included in the first LED driver 121 based on the PWM dimming signal received from the processor 130 to the first LED driver 121.

Figure 4A:
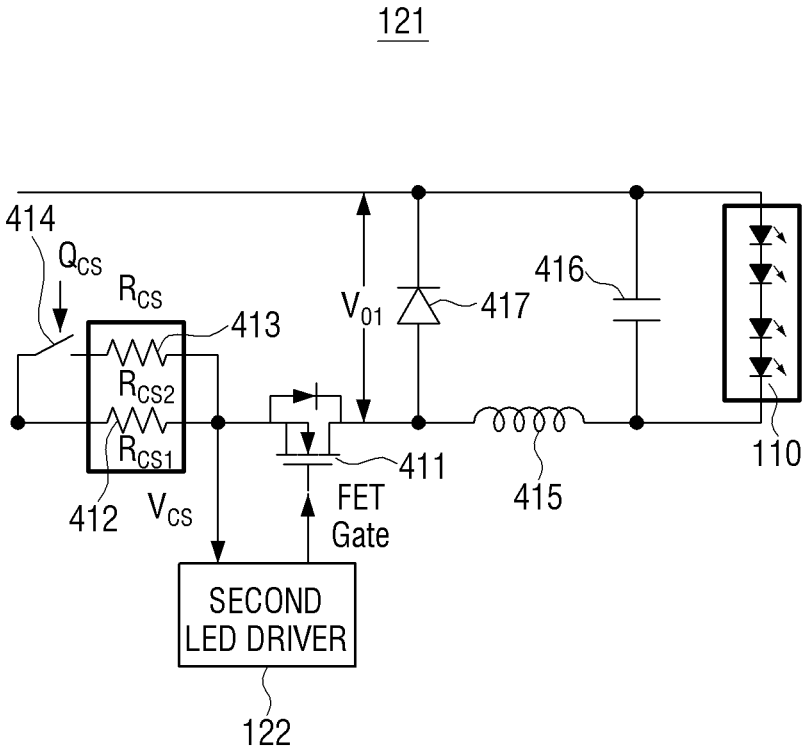
FIG. 4A is a circuit diagram illustrating an example LED driver shown in FIG. 2 according to an embodiment of the disclosure.

FIG. 4A is a circuit diagram illustrating an example LED driver shown in FIG. 2 according to an embodiment of the disclosure.

The LED driver shown in FIG. 2 may be embodied as the first LED driver 121 shown in FIG. 3, and thus this case will be illustrated and described by way of example.

The switching element 411 may perform a switching operation based on the control signal of the second LED driver 122. The switching element 411 may include one end connected to the first resistance 412 and the other end connected to one end of the inductor 415 and an anode of the first diode 417. The switching element 411 may be embodies as MOSFET for high speed switching.

One end of the first resistance 412 may be connected to one end of the switching element 411, and one end of the second resistance 413 may be connected to the first resistance 412 in parallel. The first switch 414 may be disposed between the other end of the first resistance and the other end of the second resistance. The first resistance 412 may be a sensing resistance for sensing a current flowing through the inductor 415 when the switching element 411 is turned on. A current flowing through a sensing resistance or a voltage sensed by a current flowing through the sensing resistance may be provided to the second LED driver 122, and the second LED driver 122 may control the switching operation of the switching element 411 based on the current and the voltage.

The inductor 415 may charge energy when the switching element 411 is turned on, and deliver energy to an output while maintaining current inertia when the switching element 411 is turned off. One end of the inductor 415 may be connected to both the anode of the first diode 417 and the other end of the switching element 411, and the other end of the inductor 415 may be connected to the other end of the LED module 110.

The first capacitor 416 may include one end connected to both the cathode of the first diode 417 and one end of the LED module 110, and the other end connected to both the other end of the LED module 110 and the other end of the inductor 415. The first capacitor 416 may be a rectifier capacitor connected to an output voltage (Vo) in parallel. When the switching element 411 performs switching with a predetermined duty (e.g., 50%), $V_{D1}$ voltage may become a square wave, and perform a rectifying function of flattening the square wave so that a DC voltage may be supplied to the output.

The first diode 417 may connect in a reverse bias at the turn-on time, and form a pass so that an inductor current may flow toward the output at the turn-off time. The first diode 417 may include a cathode connected to one end of the LED module 110, and an anode connected to the other end of the switching element 411.

Figure 4B:
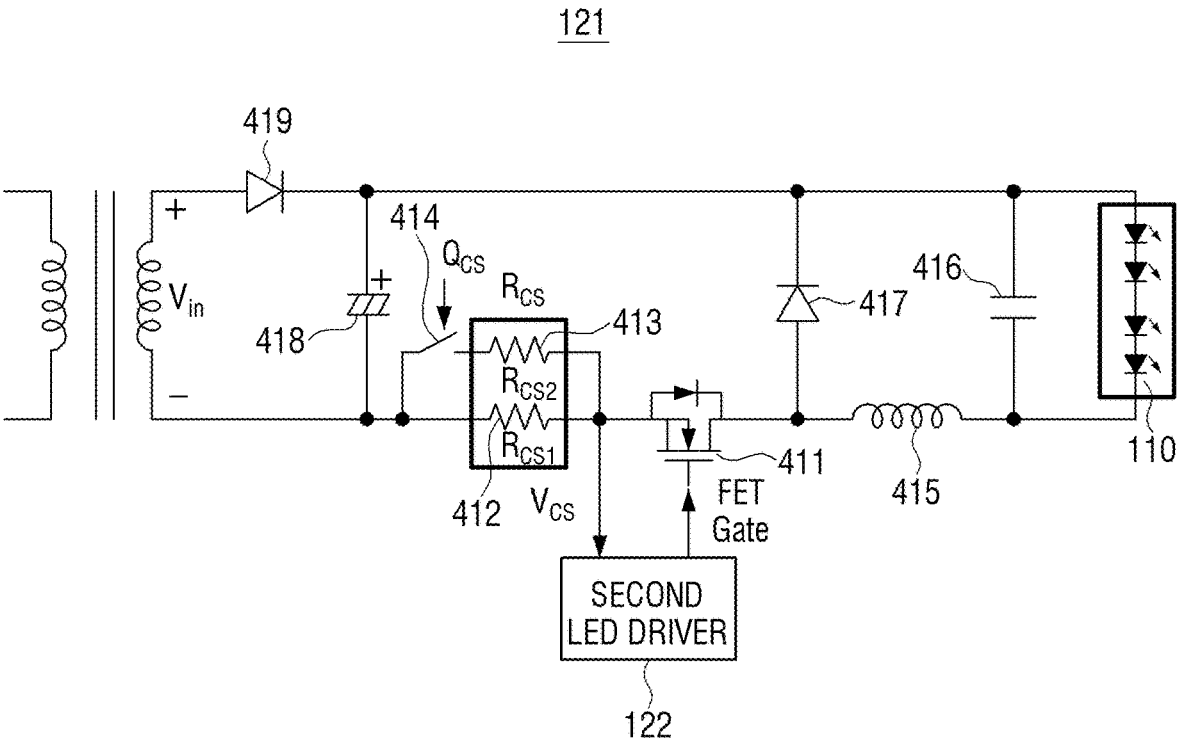
FIG. 4B is a circuit diagram illustrating an example LED driver shown in FIG. 2 according to another embodiment of the disclosure.

FIG. 4B is a circuit diagram illustrating an example LED driver shown in FIG. 2 according to another embodiment of the disclosure.

The first LED driver shown in FIG. 4B may further include a second capacitor 418 and a second diode 419 compared to an example embodiment shown in FIG. 4A.

The second capacitor 418 may be a decoupling capacitor connected to an input voltage (Vin) in parallel. The decoupling capacitor may supply a stable DC voltage to an output terminal when noise is added to an input voltage, or a voltage is shaking. The second capacitor 418 may include one end connected to a cathode of the second diode 419 and the other end connected to a ground terminal of the input voltage (Vin). The second capacitor 418 may include one end connected to both the cathode of the second diode 419 and one end of the LED module 110, and other end connected to both the ground terminal of the input voltage (Vin) and the first resistance 412.

The second diode 419 may be connected to the input voltage (Vin) and the cathode may be connected to one end of the LED module 110.

Figure 5A:
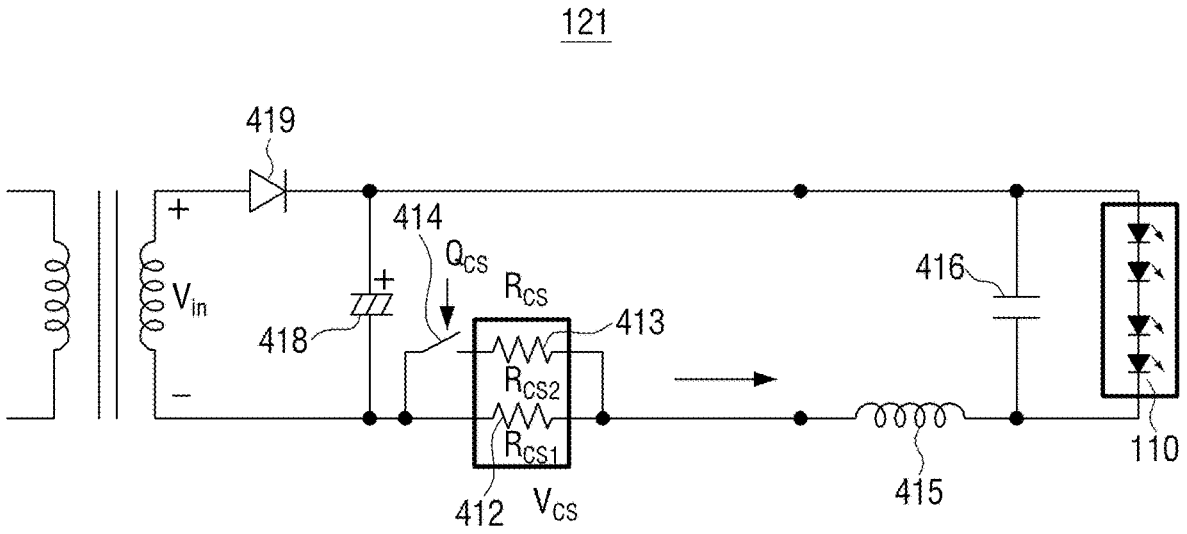
FIG. 5A is a diagram illustrating an equivalent circuit of an example LED driver when a switching element is on according to an embodiment of the disclosure.

FIG. 5A is a diagram illustrating an equivalent circuit of an example LED driver when a switching element is on.

Referring to FIG. 5A, when the switching element 411 is turned on, the current in the current path may rise while the inductor 415 is charged. The first diode 417 may be open-circuited, and a power by the charge charged by the first capacitor 416 may be supplied to the LED module 110.

Figure 5B:
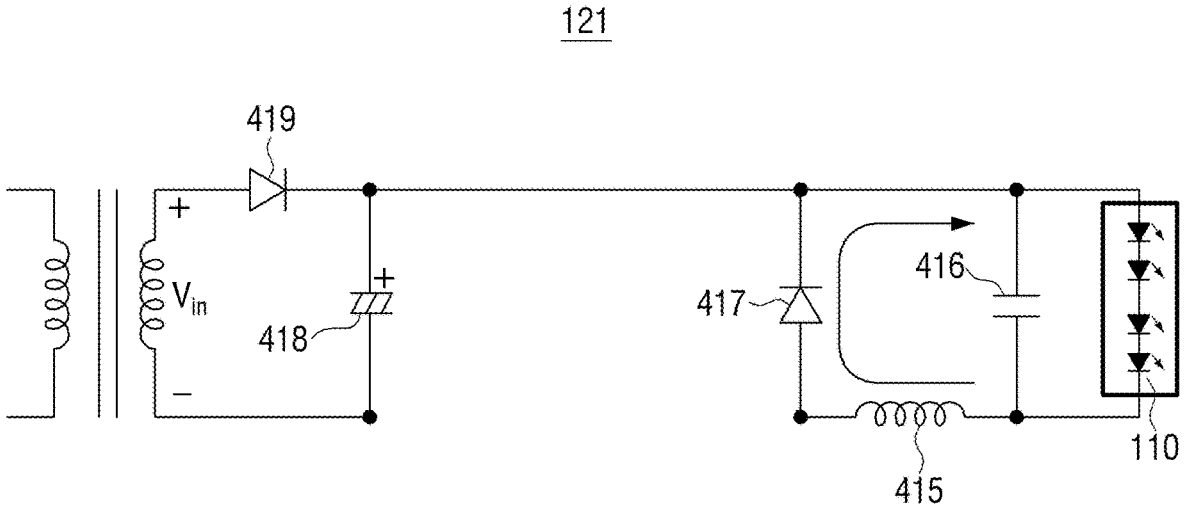
FIG. 5B is a diagram illustrating an equivalent circuit of an LED driver when a switching element is off according to an embodiment of the disclosure.

FIG. 5B is a diagram illustrating an equivalent circuit of an example LED driver when a switching element is off.

Referring to FIG. 5B, when the switching element 411 is turned off, the current charged in the inductor 415 may be discharged to load, e.g., the LED module 110 side.

The circuit shown in FIG. 4A and FIG. 4B may use a peak current mode control method for measuring a current while the inductor 415 is charged among current mode control methods for sensing the current of the inductor 415 and controlling an output voltage, but the disclosure is not limited thereto. For example, the constant current may be provided to the LED module 110 in a discontinuous conduction mode (DCM) or a critical conduction mode (CRM), which are classified according to the waveform of the current flowing through the inductor 415. Depending on the inductor and rated power and load design, the inductor may operate using CCM or DCM. When the inductor operates with DCM or CRM, the inductor current may start from 0 when the next switching occurs, so that high efficiency may be obtained according to the switching operation. However, if the embodiment according to the disclosure is applicable, it is also possible to supply a constant current to the LED module 110 in a continuous conduction mode (CCM).

Figure 6A:
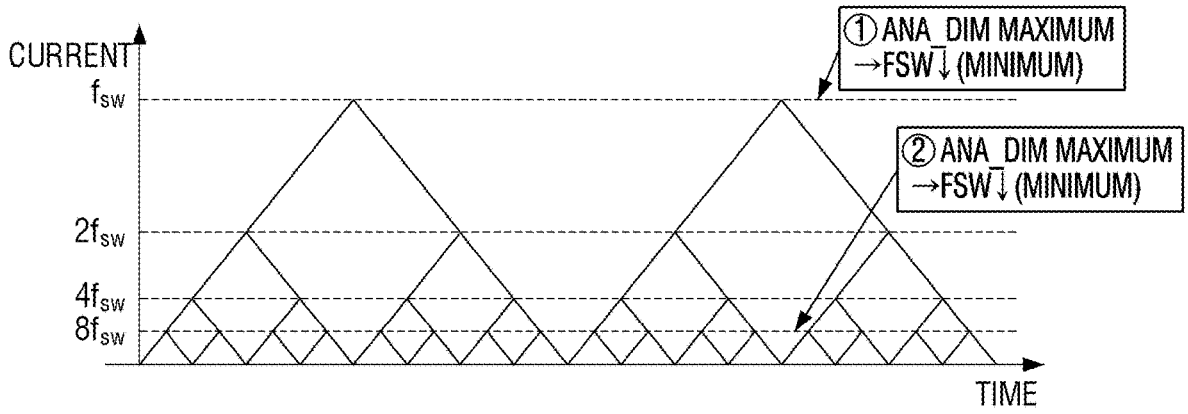
FIG. 6A and FIG. 6B are diagrams illustrating examples of a peak current mode controlling method according to an embodiment of the disclosure.
Figure 6B:
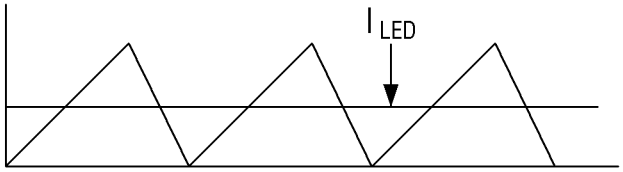

According to a peak current mode control method, as shown in FIG. 6A, the switching frequency may change according to the output current of the LED module 110, that is, the magnitude of the LED current (analog dimming level). As the intensity of the LED current increases, the switching frequency may be reduced, and when the intensity of the LED current is reduced, the switching frequency may increase. For example, if the voltage Vcs generated by the current through the LED current intensity Rcs falls below a desired reference current (or reference voltage), the duty of the switching device 411 may increase and the current charged to the inductor 415 may increase, and accordingly, the output current gradually may increase. On the other hand, when the intensity of the LED current (the voltage Vcs generated by a current flowing through the Rcs) is higher than a reference current (a reference voltage), the duty of the switching element 411 may be reduced, and the current charged to the inductor 415 may be reduced, which could reduce the output current accordingly. For this operation, a first LED driver 121 may identify the output current of the LED module 110 by using the voltage value Vcs of the first and second resistances 412 and 413.

By the circuit operation according to an embodiment of the disclosure, when the Rcs increases, the intensity of the LED current may be reduced, and when the Rcs is reduced, the intensity of the LED current may increase. In other words, as the Rcs value changes, the intensity of the LED current may be changed.

The processor 130, when a pixel value of an input image is less than a threshold value, may turn off a first switch (Qcs) 414, and increase the Rcs to reduce the intensity of the current provided to the LED module 110. Accordingly, the switching frequency of the switching element 411 may increase. The step change in the brightness may be easily visible in the low grayscale level image, and thus linearity may be increases by increasing the switching frequency.

For example, in the case of a 10-bit image, if the dimming frequency is 120 Hz, (1/120)/1023=8.14 uS, so when the grayscale is increased by one step, then 1/8.14 uS=123 kHz, when the switching frequency is 120 Hz, (1/240)/1023=4.07 uS, so when the grayscale increases by one step, 1/4.07 uS=246 kHz. However, since the LED driver typically uses a switching frequency of 60 to 110 kHz, one switching may not be performed per one step. However, if the switching frequency is increased in the entire operation period, the heat generation may increase and the price may increase. Thus, according to one embodiment of the disclosure, the switching frequency may be increased only in a low grayscale level image.

The processor 130, when a pixel value of an input image is equal to or more than a threshold value, may turn on the first switch (Qcs) 414, and reduce the Rcs to increase the intensity of the current provided to the LED module 110. Accordingly, the switching frequency of the switching element 411 may be reduced. In the high grayscale level image, since the step change of the brightness is not a big problem, even if the switching frequency is reduced, no problem occurs.

Figure 7A:
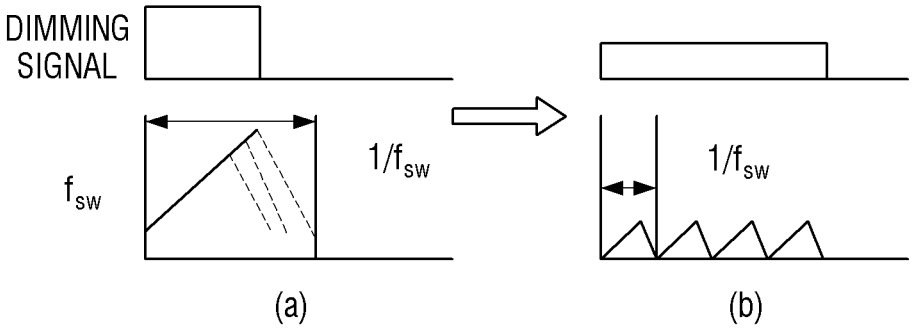
FIG. 7A and FIG. 7B are diagrams illustrating an example method for changing a dimming duty according to an embodiment of the disclosure.
Figure 7B:
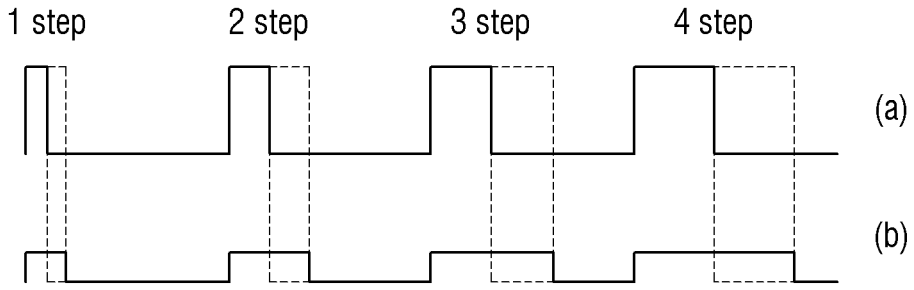

However, the processor 130 may compensate the dimming duty of the PWM dimming signal based on the intensity of the current reduced as the resistance or the switching frequency increases. In other words, when the intensity of the current reduced according to the resistance increase, or the switching frequency increases within the same duty, the average magnitude of the LED current may be reduced. Therefore, the processor 130 may compensate the luminance degradation as the dimming duty of the PWM dimming signal in advance, and provide the compensated PWM dimming signal to the LED driver 120. For example, as shown in FIG. 7A, by increasing the duty (FIG. 7A(b)) of the existing dimming signal (FIG. 7A(a)), the luminance decrease due to the decrease of the intensity of the current and the increase of the switching frequency may be compensated. As shown in FIG. 7B, the intensity of the current provided to the LED (FIG. 7B(b)) may be reduced compared to the case of the dimming signal (FIG. 7B(a)), and the luminance degradation may be compensated by increasing the dimming duty.

Figure 8A:
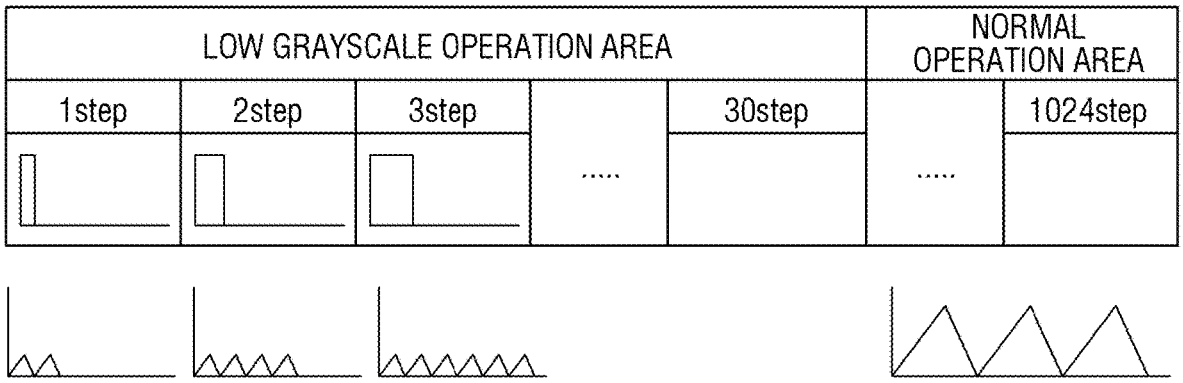
FIG. 8A and FIG. 8B are diagrams illustrating an example method for providing grayscale information according to an embodiment of the disclosure.
Figure 8B:
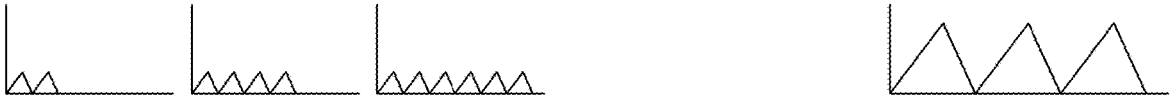

The LED driver 120 may operate according to the PWM dimming signal, and thus there may be no way to identify whether the image is a low grayscale level image. Accordingly, the processor 130 may provide a separate signal indicating the PWM dimming signal is a low grayscale signal corresponding to a low grayscale image to the LED driver 120. As shown in FIG. 8A, the processor 130 may provide a signal indicating grayscale information in the form of PWM signal to the LED driver 120 apart from the PWM dimming signal. The LED driver 120 may identify that the PWM dimming signal corresponds to a low grayscale image based on the PWM dimming signal and increase the switching frequency of the switching element. For example, the processor 130 may provide a signal indicating grayscale information to the LED driver 120 in the form of a digital signal as shown in FIG. 8B. The LED driver 120 may identify that the PWM dimming signal is a signal corresponding to a low grayscale image based on the digital signal and increase the switching frequency of the switching element.

Figure 9:
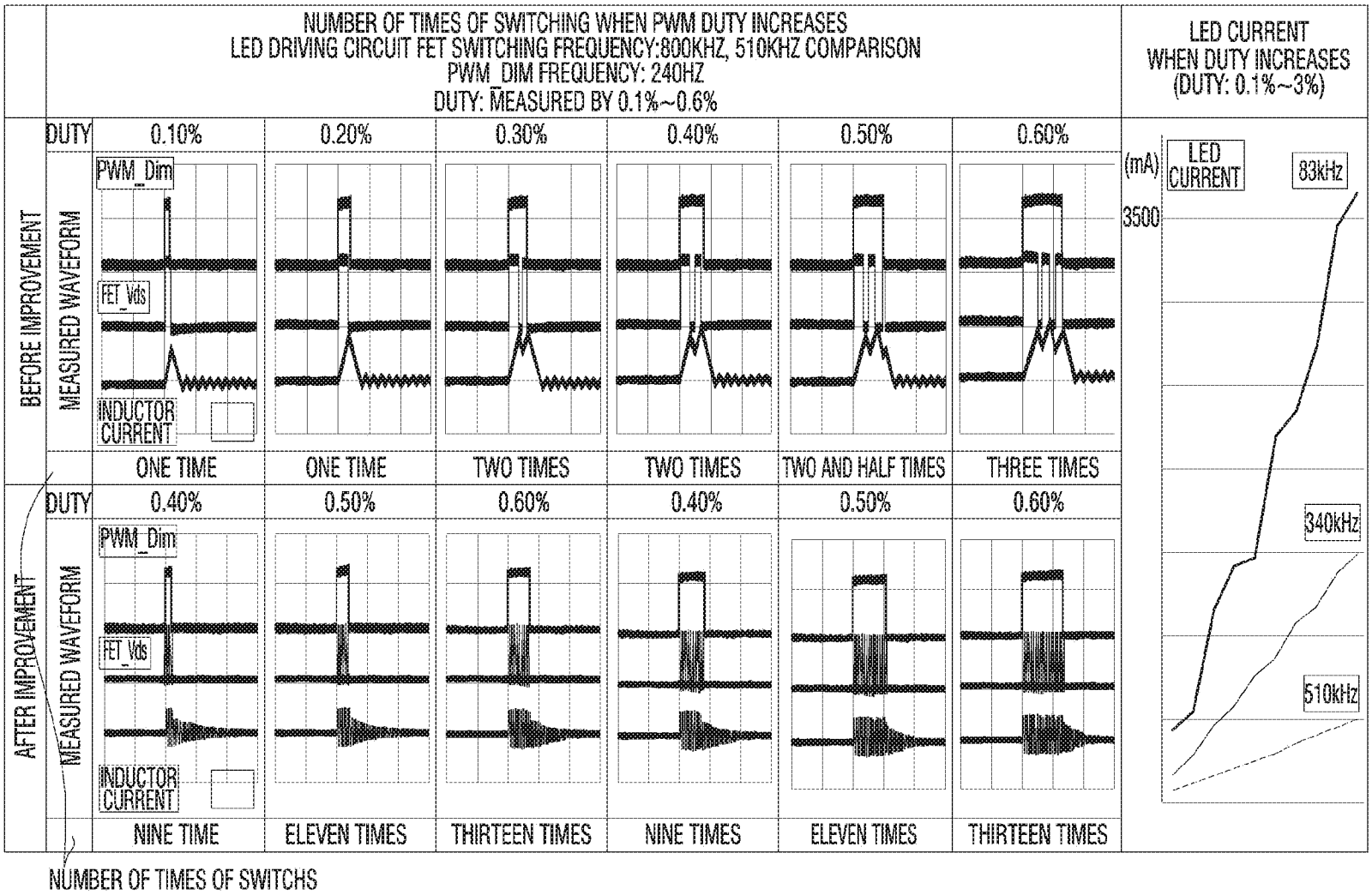
FIG. 9 is a diagram illustrating example effectiveness according to an embodiment of the disclosure.

FIG. 9 is a diagram illustrating example effectiveness according to an embodiment of the disclosure.

FIG. 9 is a view illustrating experimental data to which an embodiment is applied. For example, the switching frequency was increased to 500 kHz at a 240 Hz dimming frequency. In this case, when expressing 10-bit image, that is, 1024-grayscale, one step was converted into PWM duty (1/1023*100(%)=0.098%) and the PWM duty was increased by about 0.1%. Referring to FIG. 5, the number of switching operations per grayscale 1 step increases by two times, and linearity may be increased in a low grayscale range accordingly.

Figure 10:
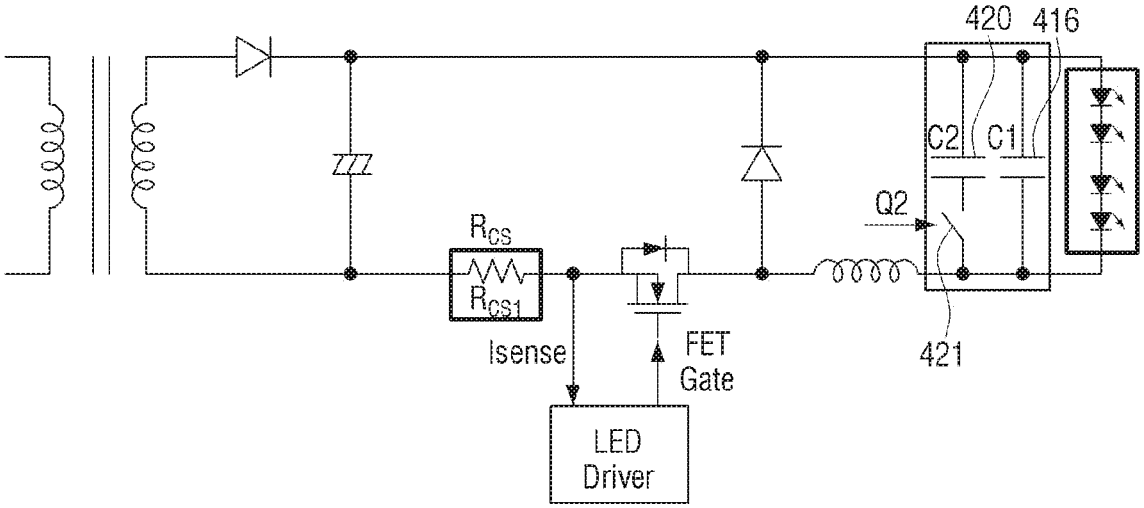
FIG. 10 is a circuit diagram illustrating an example LED driver according to another embodiment of the disclosure.

FIG. 10 is a circuit diagram illustrating an example LED driver according to another embodiment of the disclosure.

Referring to FIG. 10, the LED driver 120 may further include a third capacitor 420 including one end connected to a first capacitor 416, and a second switch 421 disposed between the other end of the first capacitor 416 and the other end of the third capacitor 420. The processor 130 may control the LED driver 120 to turn off the second switch 421 when a pixel value of an input image is less than a threshold value, and turn on the second switch 421 when a pixel value of an input value is equal to or more than a threshold value. When the second switch 421 is turned off, only the first capacitor 416 may be connected to the LED driver 120, but when the second switch 421 is turned on, the first capacitor 416 and the third capacitor 420 may be connected in parallel.

For example, the LED driver 120 may turn off the second switch 421 when the PWM dimming signal is an image signal less than a threshold value, and may turn on the second switch 421 when the PWM dimming signal is an image signal equal to or more than a threshold value. When a pixel value of an input image is a low grayscale image less than a threshold value, the LED driver 120 may turn off the second switch 421 so that only the first capacitor 416 may be connected to the LED driver 120, thereby improving Rising time and Falling Time by reducing output capacitor capacity.

Figure 11:
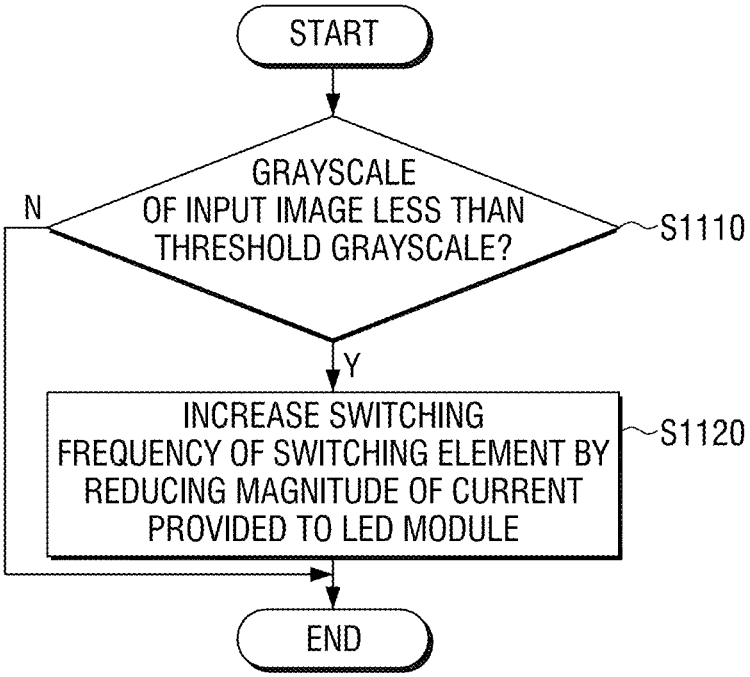
FIG. 11 is a flowchart illustrating an example method of controlling a display apparatus according to an embodiment of the disclosure.

FIG. 11 is a flowchart illustrating an example method for controlling a display apparatus according to an embodiment of the disclosure.

FIG. 11 illustrates a method for controlling a display apparatus including a switching element and an LED driver for changing a switching frequency of a switching element based on the intensity of a current provided to an LED module.

Referring to FIG. 11, a Pulse Width Modulation (PWM) dimming signal may be generated based on pixel information of an input image and provided to an LED driver in step S1110.

When a value of an input image is less than a threshold value, the switching frequency of the switching element may increase by reducing the intensity of the current provided to the LED module in step S1120.

In this case, the LED driver may operate to increase the switching frequency of the switching element when the intensity of the current provided to the LED module is reduced, and to reduce the switching frequency of the switching element when the intensity of the current provided to the LED module increases.

The controlling method may include obtaining a dimming duty of a PWM dimming signal based on pixel information of an input image, compensating a dimming duty obtained based on the intensity of a current reduced when a pixel value of an input image is less than a threshold value, and providing the PWM dimming signal for which a dimming duty is compensated to the LED driver.

The controlling method may further include LED driver receiving a signal indicating pixel information related to the PWM dimming signal.

The increasing of the switching frequency of the switching element S1120 may include the switching frequency of the switching element when the PWN dimming signal is identified as corresponding to an image signal less than a threshold value based on the received pixel information.

The LED driver may include a first resistance including one end connected to one end of the switching element, a second resistance connected to the first resistance, and a first switch disposed between the other end of the resistance and the other end of the second resistance. The increasing of the switching frequency of the switching element S1120 may include turning off the first switch when an pixel value of an input image is equal to or more than a threshold value so that the first resistance and the second resistance may not be connected, and turning on the first switch when a pixel value of an input image is less than a threshold value so that the first resistance and the second resistance may be connected to each other in parallel.

The LED driver may include a first diode including a cathode connected to one end of an LED module and an anode connected to the other end of the switching element, an inductor including one end connected to an anode of the first diode and the other end of the switching element, and the other end connected to the other end of the LED module, and a first capacitor including one end connected to both a cathode of the first diode and one end of the LED module, and the other end connected to both the other end of the LED module and the other end of the inductor. In this case, one end of the first resistance may be connected to a ground terminal of an input power source, and the other end may be connected to one end of the switching element.

The LED driver may include a second diode including an anode connected to an input power source, and a cathode connected to one end of an LED module, and a second capacitor including one end connected to a cathode of the second diode and the other end connected to a ground terminal of an input power source.

The LED driver may further include a third capacitor including one end connected to the first capacitor, and a second switch disposed between the other end of the first capacitor and the other end of the third capacitor. The controlling method may include controlling the LED driver to turn off the second switch when a pixel value of an input image is less than a threshold value, and to turn on the second switch when a pixel value of an input image is equal to or more than a threshold value.

According to the above-described example embodiment, the generating of the PWM signal is performed by the processor 130 provided in the display apparatus 100, but when a display is provided separately, the operation may be performed by an image processing apparatus (not shown). For example, the image processing apparatus may be embodied as various devices capable of image processing such as a set-top box, a sending box, etc.

The methods according to various example embodiments of the disclosure may be embodied in the form of application that can be installed on a conventional electronic apparatus.

The methods according to various example embodiments of the disclosure may be embodied as software upgrade or hardware upgrade with respect to a conventional electronic apparatus.

The various embodiments of the disclosure may be performed by an embedded server provided in the display apparatus 100 or an external server of the display apparatus 100.

In some cases, the embodiments described herein may be implemented by processor 130 itself. According to software implementation, embodiments such as the procedures and functions described herein may be implemented in separate software modules. Each of the software modules may perform one or more of the functions and operations described herein.

Computer instructions for performing a processing operations of the display apparatus 100 in accordance with various embodiments described above may be stored in a non-transitory computer-readable medium. The computer instructions stored in the non-transitory computer-readable medium may cause a particular device to perform the processing operation on the display apparatus 100 according to various embodiments described above when executed by the processor of the particular device.

The non-transitory computer readable medium stores data semi-permanently, and is readable by an apparatus. For example, the above-described various applications or programs may be stored in a non-transitory computer readable medium such as a compact disc (CD), a digital versatile disk (DVD), a hard disk, a Blu-ray disk, a universal serial bus (USB) memory stick, a memory card, and a read only memory (ROM), and may be provided.

Although various example embodiments have been illustrated and described, it will be appreciated by those skilled in the art that changes may be made to these embodiments without departing from the principles and spirit of the disclosure. Accordingly, the scope of the disclosure is not limited to the described embodiments, but may be defined, for example, by the appended claims as well as equivalents thereto.

What is claimed is:

1. A display apparatus, comprising:

a Light Emitting Diode (LED) module including a plurality of light emitting diodes;

an LED driver including a switching element comprising switching circuitry, the LED driver configured to change a switching frequency of the switching element based on an intensity of a current provided to the LED module; and a processor configured to generate a Pulse Width Modulation (PWM) dimming signal based on pixel information of an input image and to provide the PWM dimming signal to the LED driver, wherein the processor is further configured to control the LED driver to increase the switching frequency of the switching element within a dimming duty of the PWM dimming signal by reducing the intensity of the current provided to the LED module based on a pixel value of the input image being less than a threshold value.

2. The display apparatus as claimed in claim 1, wherein the processor is disposed on a main board, and the LED driver is disposed on a power board, and wherein the main board is configured to provide the PWM dimming signal generated by the processor to the power board.

3. The display apparatus as claimed in claim 1, wherein the LED driver is configured to increase the switching frequency of the switching element based on the intensity of the current provided to the LED module being reduced, and to reduce the switching frequency of the switching element based on the intensity of the current provided to the LED module being increased.

4. The display apparatus as claimed in claim 1, wherein the processor is further configured to:

obtain the dimming duty of the PWM dimming signal based on the pixel information of the input image;

compensate the obtained dimming duty based on the reduced intensity of the current based on the pixel value of the input image being less than the threshold value; and provide the PWM dimming signal for which the dimming duty is compensated to the LED driver.

5. The display apparatus as claimed in claim 1, wherein the processor is configured to provide a signal indicating pixel information related to the PWM dimming signal to the LED driver, and wherein the LED driver is configured to increase the switching frequency of the switching element based on the PWM dimming signal corresponding to an image signal being less than the threshold value based on the pixel information.

6. The display apparatus as claimed in claim 1, wherein the LED driver comprises:

a first resistance comprising at least on first resistor including one end connected to one end of the switching element;

a second resistance comprising at least one second resistor including one end connected to the first resistance; and a first switch disposed between another end of the first resistance and another end of the second resistance, and wherein the processor is further configured to control the LED driver to:

turn off the first switch to prevent the first resistance from being connected to the second resistance based on the pixel value of the input image being equal to or greater than the threshold value, and turn on the first switch to connect the first resistance to the second resistance in parallel based on the pixel value of the input image being less than the threshold value.

7. The display apparatus as claimed in claim 6, wherein the LED driver is further configured to:

increase the switching frequency of the switching element based on a current sensed by the first resistance being reduced as the first resistance and the second resistance are not connected; and reduce the switching frequency of the switching element based on a current sensed by the first resistance and the second resistance being increased as the first resistance and the second resistance are connected in parallel.

8. The display apparatus as claimed in claim 7, wherein the LED driver further comprises:

a first diode including a cathode connected to one end of the LED module and an anode connected to another end of the switching element;

an inductor including one end connected to an anode of the first diode and the other end of the switching element, and another end of the inductor connected to another end of the LED module; and a first capacitor including one end connected to both a cathode of the first diode and one end of the LED module, and another end of the first capacitor connected to both the other end of the LED module and the other end of the inductor, wherein one end of the first resistance is connected to a ground terminal of an input power source, and the other end is connected to one end of the switching element.

9. The display apparatus as claimed in claim 8, wherein the LED driver comprises:

a second diode including an anode connected to the input power source and a cathode connected to one end of the LED module; and a second capacitor including one end connected to a cathode of the second diode, and another end connected to a ground terminal of the input power source.

10. The display apparatus as claimed in claim 8, wherein the LED driver comprises:

a third capacitor including one end connected to the first capacitor; and a second switch disposed between the other end of the first capacitor and another end of the third capacitor, wherein the processor is further configured to control the LED driver to: turn off the second switch based on the pixel value of the input image being less than the threshold value, and turn on the second switch based on the pixel value of the input image being equal to or greater than the threshold value.

11. The display apparatus as claimed in claim 1, wherein the LED driver is configured to operate according to a peak current mode control method.

12. The display apparatus as claimed in claim 1, wherein the LED driver comprises:

a first driver including the switching element, the first driver configured to control the current provided to the LED module through a switching operation of the switching element; and a second driver configured to provide a control signal to control the switching operation of the switching element to the first driver.

13. A method for controlling a display apparatus including a switching element and a Light Emitting Diode (LED) driver that changes a switching frequency of the switching element based on an intensity of a current provided to an LED module, the method comprising:

generating a Pulse Width Modulation (PWM) dimming signal based on pixel information of an input image and providing the PWM dimming signal to the LED driver; and increasing the switching frequency of the switching element within a dimming duty of the PWM dimming signal by reducing the intensity of the current provided to the LED module based on a pixel value of the input image being less than a threshold value.

14. The method as claimed in claim 13, wherein the LED driver is configured to increase the switching frequency of the switching element based on the intensity of the current provided to the LED module being reduced, and to reduce the switching frequency of the switching element based on the intensity of the current provided to the LED module being increased.

15. The method as claimed in claim 13, further comprising:

obtaining the dimming duty of the PWM dimming signal based on the pixel information of the input image, and compensating the obtained dimming duty based on the reduced intensity of the current based on the pixel value of the input image being less than the threshold value; and providing the PWM dimming signal for which the dimming duty is compensated to the LED driver.

16. The method as claimed in claim 13, further comprising:

receiving a signal indicating pixel information related to the PWM dimming signal by the LED driver, wherein the increasing of the switching frequency of the switching element comprises, increasing the switching frequency of the switching element based on identification that the PWM dimming signal corresponds to an image signal less than the threshold value based on the pixel information.

17. The method as claimed in claim 13, wherein the LED driver comprises:

a first resistance including one end connected to one end of the switching element;

a second resistance including one end connected to the first resistance; and a first switch disposed between the other end of the first resistance and another end of the second resistance, wherein the increasing of the switching frequency of the switching element comprises controlling the LED driver to:

turn off the first switch to prevent the first resistance from being connected to the second resistance based on the pixel value of the input image being equal to or greater than the threshold value; and based on the pixel value of the input image being less than the threshold value, turn on the first switch to connect the first resistance to the second resistance in parallel based on the pixel value of the input image being less than the threshold value.

18. The method as claimed in claim 17, wherein the LED driver is configured to:

increase the switching frequency of the switching element based on a current sensed by the first resistance being reduced as the first resistance and the second resistance are not connected; and reduce the switching frequency of the switching element based on a current sensed by the first resistance and the second resistance being increased as the first resistance and the second resistance are connected in parallel.

19. The method as claimed in claim 18, wherein the LED driver comprises:

a first diode including a cathode connected to one end of the LED module, and an anode connected to another end of the switching element;

an inductor including one end connected to both an anode of the first diode and the other end of the switching element, and another end of the inductor connected to the other end of the LED module; and a first capacitor including one end connected both to a cathode of the first diode and one end of the LED module, and another end of the first capacitor connected to the other end of the LED module and the other end of the inductor, wherein one end of the first resistance is connected to a ground terminal of an input power source, and another end of the first resistance is connected to one end of the switching element.

20. The method as claimed in claim 19, wherein the LED driver further comprises:

a third capacitor including one end connected to the first capacitor; and a second switch disposed between the other end of the first capacitor and another end of the third capacitor, and wherein the method further comprises controlling the LED driver to turn off the second switch based on the pixel value of the input image being less than the threshold value, and to turn on the second switch based on the pixel value of the input image being equal to or greater than the threshold value.

* * * * *